United States Patent [19]

Aloziem

[11] Patent Number: 4,457,103

[45] Date of Patent: Jul. 3, 1984

[54] DECORATIVE POTTERY

[76] Inventor: Victor I. Aloziem, 410 NE. 14th, Oklahoma City, Okla. 73104

[21] Appl. No.: 301,426

[22] Filed: Sep. 9, 1981

[51] Int. Cl.[3] ..... B65D 25/14

[52] U.S. Cl. ..... 47/66; 215/1 R; 220/457

[58] Field of Search ..... 47/66; 206/423; 220/429, 454, 457; 215/1 R

[56] References Cited

U.S. PATENT DOCUMENTS

| | | | |
|---|---|---|---|
| 1,689,418 | 10/1928 | Young | 47/66 X |
| 2,810,989 | 10/1957 | Terry | 47/66 |
| 3,992,811 | 11/1976 | Yellin | 47/69 |
| 4,034,507 | 7/1977 | Dedolph | 47/84 X |
| 4,035,951 | 7/1977 | Dedolph | 47/66 |

*Primary Examiner*—Donald F. Norton

*Attorney, Agent, or Firm*—Robert K. Rhea

[57] ABSTRACT

Decorative pottery having a glass outer layer, colored sand or salt as a middle layer and an inner layer of plaster of paris. The said or salt granules are bonded together by glue.

5 Claims, 1 Drawing Figure

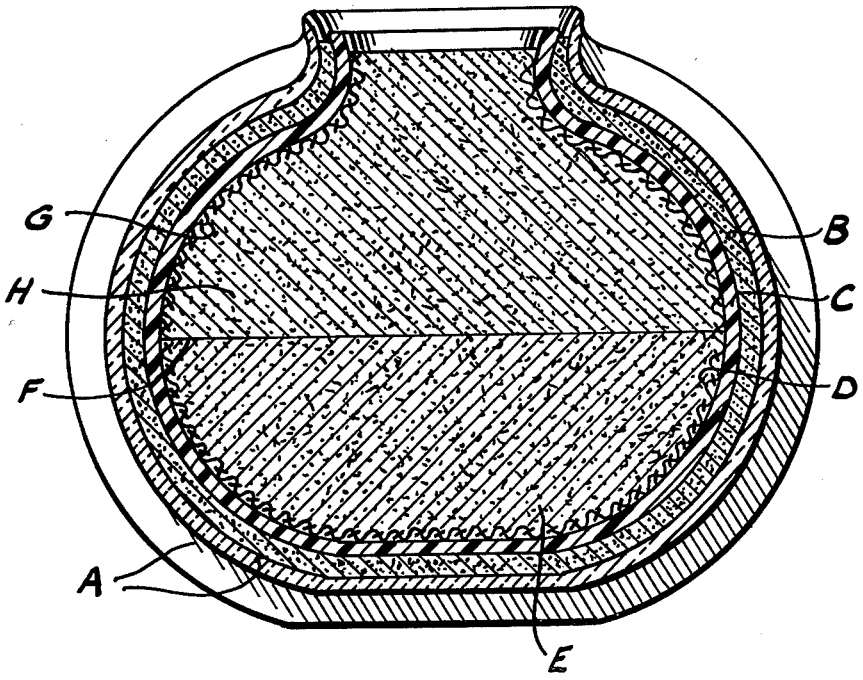
G
H
F
A
B
C
D
E

DECORATIVE POTTERY

BACKGROUND OF THE INVENTION

1. Field of the Invention

This invention relates to pottery construction and deals mainly with the descrepancy between the beauty of house plants and the containers in which they grow. It is well known that house plants contribute to the beauty and mystique of a home. However same cannot be said of the flower pots which happen to be part of that process.

2. Description of the Prior Art

The conventional flower pots are not made to contribute to the beauty of the home but just as dirt holders from which a plant could grow. The implication is that no thought is given to the flower pot and every thought given to the plant even though the plant and pot are part of the same process. It is not surprising therefore to see a beautiful plant in a well decorated home sitting in a dirty looking pot. In fact such contrasts become more vivid when such flower pots sit on a glass table with chrome plated legs. It indeed looks alien to the table. This invention tends to correct this by blending the beauty of the home or the table with that of the flower pot and plant.

As has been mentioned earlier, most people give little thought to their flower pots. But once one stops to think of it, the flower pot and plant are both playing the same role in the home as any painting which is decoration. The fact that most flower pots are not playing this role is why they are generally the first to go when ever there is a need for a change. In other words, the ordinary flower pots are generally less valued than any furniture in the home even though they may not be the least expensive. Again this decorative pottery is intended to be so good as a decorative object that it is regarded in value no less than any artifact in the home.

Another objective of this invention is to offer an alternative to the regular clay, ceramic or plastic flower pots. It contributes to the pool of pottery from which people could make a choice.

Finally, the invention was intended not only to incorporate all the above mentioned qualities but to be also cheap to produce. A product that is affordable to the ordinary man. It is only in this regard can the invention be able to meet all of its objectives.

These objectives and other features of the invention will be better understood from the following description taken in conjunction with the accompanying drawing.

BRIEF DESCRIPTION OF THE DRAWING

The single FIGURE is a vertical cross section.

In the drawing, A is the glass which serves as the outer layer and B is the colored sand or salt. C is a layer of polyethylene lining that protects the lower and upper parts respectively of the inner sand E and H from getting wet, D and G are the lower and upper parts, respectively, of a layer of cloth that holds the inner sand in place. They hold the outer colored sand in place till they are hard.

A hole or holes, not shown, are bored through the bottom of the glass bowl. They serve as drainage. The cloths D and G are sewn to the shape of the bowl. The polyethylene layer C is lowered into the bowl and secured to the bottom of the bowl. The cloth D is lowered into the bowl. Sand E is poured into the center of the bowl up to half way F between the base and neck of the bowl. The colored sand B is then poured into the space between the glass A and the polyethylene layer C in such a way as to create a decorative pattern. This decoration is brought up to the level of the upper edge F of the first half of the inner sand E. A solution of clear (colorless) glue is poured into this colored sand B so as to wet it completely. The inner sand E is then pushed to create a pressure distributed uniformly around the bowl. The sand H is again poured into the center of the bowl up to the neck of the bowl. Additional colored sand B is poured into the space between the polyethylene layer C and the bowl to create a continuous pattern up to the neck of the bowl. Pressure is applied to the center sand H to hold the colored sand B in place. More clear glue is poured into the colored sand B to completely wet it. The entire unit is then put into oven, not shown, at a low temperature to dry. When dried, the inner sand E and H, the cloths D and G, and the polyethylene layer C are removed. The glue will hold the colored sand B in place, forming a hard surface. A paste of plaster of paris, not shown, is brushed on the hard inner surface of the pottery to a desired thickness. A plastic can be used for this layer instead of the plaster of paris. This creates a pot with a glass outer layer, a middle layer of colored sand and an inner layer of plastic or plaster of paris. A sealant should be applied to the plaster of paris to make it water proof.

The art of colored sand in glass is not new, but I believe this is the first time it has been made in such a way that it cannot mix up when turned upside down. It is also the first time it has been put to practical use. It is in this respect and in the light of the above description that I make the following claims.

I claim:

1. A container that has glass as the outer layer, colored sand or salt as a middle layer and an inner layer of plaster of paris.

2. The container according to claim 1 and further including:

a bonding agent for preventing relative movement between the colored sand or salt granules.

3. The container according to claim 2 in which said middle layer of sand or salt is saturated with bonding agent.

4. The container according to claim 3 in which said inner layer is waterproof.

5. The container according to claim 1 in which said inner layer is waterproof.

* * * * *